US010843033B1

(12) United States Patent
Sotis et al.

(10) Patent No.: US 10,843,033 B1
(45) Date of Patent: Nov. 24, 2020

(54) CORE WHEEL WITH COLLAPSIBLE HANDLES

(71) Applicant: Prism Fitness, Inc., Verona, WI (US)

(72) Inventors: William J. Sotis, Fitchburg, WI (US); Weng Kin Chen, Shanghai (CN)

(73) Assignee: PRISM FITNESS, INC., Verona, WI (US)

( * ) Notice: Subject to any disclaimer, the term of this patent is extended or adjusted under 35 U.S.C. 154(b) by 0 days.

(21) Appl. No.: 16/295,264

(22) Filed: Mar. 7, 2019

Related U.S. Application Data

(60) Provisional application No. 62/640,326, filed on Mar. 8, 2018.

(51) Int. Cl.

| | |
|---|---|
| ***A63B 21/00*** | (2006.01) |
| ***A63B 23/02*** | (2006.01) |
| ***A63B 21/22*** | (2006.01) |
| ***A63B 22/20*** | (2006.01) |
| ***A63B 71/00*** | (2006.01) |

(52) U.S. Cl.
CPC ..... *A63B 21/4035* (2015.10); *A63B 21/22* (2013.01); *A63B 23/0211* (2013.01); *A63B 23/0238* (2013.01); *A63B 71/0054* (2013.01); *A63B 22/20* (2013.01); *A63B 2071/0072* (2013.01); *A63B 2210/50* (2013.01)

(58) Field of Classification Search
CPC . A63B 21/4035; A63B 21/22; A63B 23/0211; A63B 71/0054; A63B 23/0238; A63B 2071/0072; A63B 2210/50; A63B 21/00; A63B 21/20; A63B 21/0211; A63B 22/20–208; A63B 23/02–0238; A61H 15/00; A61H 2015/0007–0064
See application file for complete search history.

(56) References Cited

U.S. PATENT DOCUMENTS

| | | | | |
|---|---|---|---|---|
| 3,752,475 | A | 8/1973 | Ott | |
| 5,707,325 | A | 1/1998 | Chiou | |
| 6,575,883 | B1 * | 6/2003 | Hinds | A63B 21/0004 482/125 |

(Continued)

OTHER PUBLICATIONS

Sunlite Bicycle Folding Pedals, 9/16 in, pair, https://www.niagaracycle.com/categories/sunlite-bicycle-folding-pedals-9-16-in-pair, downloaded Dec. 21, 2017.

(Continued)

*Primary Examiner* — Nyca T Nguyen
(74) *Attorney, Agent, or Firm* — Stiennon & Stiennon

(57) ABSTRACT

A core wheel exercise device has a wheel with an axle and a shaft which extends through the wheel axle to which are mounted two handles. The handles in an extended configuration may be gripped or engaged by a user for exercise purposes, and in a collapsed storage configuration are aligned parallel to the wheel radius with a collapsed length equal to or slightly longer than the wheel radius so the core wheel may be supported on the ends of the handles. The handles are moved from the extended to the collapsed configuration by pushing the handles toward the wheel along dovetailed grooves in blocks on the shaft, allowing the handles to be rotated perpendicular to the shaft for storage. The blocks have an extension on one side of the shaft so the handles support a user so the handles cannot collapse under the load.

12 Claims, 4 Drawing Sheets

(56) References Cited

U.S. PATENT DOCUMENTS 6,585,627 B2 * 7/2003 Fernandez ..... A63B 21/0004 482/132
7,175,573 B1 * 2/2007 Huang ..... A63B 21/0004 446/236
7,553,267 B1 * 6/2009 Hauser ..... A63B 21/00047 482/141
7,837,603 B1 11/2010 Carnell, Sr.
8,267,846 B2 9/2012 Yang
9,067,104 B1 * 6/2015 Kim ..... A63B 22/20
9,498,676 B1 * 11/2016 Emick ..... A63B 23/04
9,623,273 B1 * 4/2017 Chen ..... A63B 23/1236
9,808,665 B1 * 11/2017 Demarais ..... A63B 21/4035
D827,738 S * 9/2018 Miller ..... D21/688
10,610,724 B2 * 4/2020 Chuang ..... A63B 71/0054
2003/0134726 A1 * 7/2003 Yu ..... A63B 21/4047 482/110
2005/0101454 A1 * 5/2005 Dworzan ..... A63B 23/14 482/110
2007/0010384 A1 * 1/2007 Roberts ..... A63B 21/4015 482/140
2011/0183824 A1 7/2011 Yang
2012/0100969 A1 * 4/2012 Brodbeck ..... A63B 23/0211 482/132
2013/0017936 A1 1/2013 Olson et al.
2013/0281270 A1 * 10/2013 Chen ..... A63B 21/025 482/132
2015/0202117 A1 * 7/2015 Ishibashi ..... A61H 15/0092 601/119
2015/0321041 A1 * 11/2015 Stephan ..... A63B 21/4035 482/132
2015/0328491 A1 11/2015 Miller et al.
2017/0072258 A1 * 3/2017 Chen ..... A63B 23/03525
2017/0080271 A1 3/2017 Miller et al.
2017/0319900 A1 * 11/2017 Ballo ..... A61H 15/0092
2018/0043213 A1 * 2/2018 Poeschl ..... A63B 71/0036
2018/0056120 A1 * 3/2018 Brown ..... A63B 21/4049
2019/0336387 A1 * 11/2019 Daley ..... A61H 15/00

OTHER PUBLICATIONS

Wellgo F265 Folding Bike Bicycle Aluminum Platform Flat Pedals, [excerpts] https://www.walmart.com/ip/Wellgo-F265-Folding-Bike-Bicycle-Aluminum-Platform-Flat-Pedals/118155397, downloaded Dec. 21, 2017.

* cited by examiner

CORE WHEEL WITH COLLAPSIBLE HANDLES

CROSS REFERENCES TO RELATED APPLICATIONS

This application claims the benefit of priority of U.S. App. No. 62/640,326 filed Mar. 8, 2018, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to an exercise device known as a core wheel which is comprised of a wheel with an axle and a shaft which extends through the wheel axle to which are mounted handles. Various exercises are performed by a user gripping the handles of the wheel. For example, the user make take up a position like that for a push-up where the user, with only portions of his or her feet touching the ground, supports the core of his or her body over the wheel. Because the wheel is free to rotate, holding this position results in strengthening the muscles required for maintaining stability. Another type of exercise begins with a kneeling position on the floor, the core wheel is again gripped by the handles and rolled forward until the belly is just above the floor and then rolled back until the weight is substantially supported on the knees. This exercise particularly strengthens the abdominal muscles as well as the muscles employed to maintain stability.

A core wheel is a relatively compact exercise device except for the axially extending shaft and the accompanying handles. Prior art devices have in some cases made the handles, and even the shaft removable to facilitate storage or packaging. However, it is desirable that exercise devices not require assembly for use, as they are generally one of several different devices used to exercise different muscle groups, and therefore any particular exercise device may be used only for a short period of time. Removing the central shaft and handle may be reasonable for shipping or long-term storage, but a device which must first be assembled before it can be used can interfere with its utility as an exercise device.

What is needed is a core wheel which can be conveniently and stably stored but which does not require assembly for use.

SUMMARY OF THE INVENTION

The core wheel of this invention employs handles which can be collapsed from an axial position in a use configuration to a radial position extending parallel to the wheel in a stored configuration which supports the wheel such that there is no tendency for the wheel to roll. In the stored configuration the axial ends of the collapsed handles together with the circumferential surface of the wheel itself form a three-point support for storing the wheel. The collapsible handles are mounted to a fork with two parallel extending arms. The parallel extending arms form inwardly facing surfaces of the fork. On the inwardly facing surfaces of each fork is a T-shaped protrusion at the distal end of each arm such that the tops of the T-shaped protrusions are parallel and opposed. In addition, the inward facing surfaces also have a protrusion of a shape formed by rotating a T about the long axis so forming a table or toadstool shape. The toadstool shape protrusion thus formed is such that a plane passing through the long axis of the T forms a T-shaped surface. The tops of each table-shaped protrusion are also opposed and parallel. A shaft extends through the axis of the wheel, and on each side of the shaft which extends out from the wheel is mounted a block which fits between the arms of the forks mounted to the handles. The blocks have a T-shaped slot on each side facing the arms of the forks. The T-shaped slots are arranged to accept both the T-shaped protrusions and the table-shaped protrusions so that the handle may be pushed axially towards the wheel to slide on the blocks. A spring-loaded piston is mounted to the handle between the arms of the forks. The spring-loaded pistons push the handles away from the blocks. Each block has two pins or fasteners which extend perpendicular to the axial and across the T-shaped slots. The T-shaped protrusions while contained in the T-shaped slots are limited in their movement along the slots by the pins or fasteners. The spring-loaded pistons acting between the handles and the axial blocks hold the T-shaped protrusions against the pins. The T-shaped protrusions and the table-shaped protrusions contained in the slots prevent rotation of the handles with respect to the blocks and thus the axle of the wheel. The T-shaped protrusions and the table-shaped protrusions are spaced apart from a moment couple which supports the load of the hands of the person exercising.

To collapse the handles, the handles are pushed toward the wheel so that the T-shaped protrusions slide out of the T-shaped slots and allow the handles to rotate about the blocks on the table-shaped protrusions. When the handles have rotated 90° the spring-loaded pistons bear against the sides of the blocks supporting the handles in the 90° rotated position. The handles have a length in the collapsed position such that the lowermost portions of the handles which form the handle bases define flat support surfaces which extend to a radial distance equal to or greater than the radius of the wheel, thus providing a two or three-point support for the core wheel. Both blocks each have a portion which extends beyond the block proper along the axial shaft on the same side of the handle as the grip surface which bears the weight of the person when exercising with the core wheel. The effect of the extension is to prevent the handles from rotating in the loaded direction when the core wheel is being used—thus preventing the handles from collapsing under the load. The invention can also be strapped to the user's feet for exercises in the prone or supine position.

It is an object of the present invention to provide a core wheel which may be collapsed for storage.

It is another object of the present invention to provide a core wheel which can render the wheel stable when positioned on a flat surface when not in use.

It is a further object of the present invention to provide a core wheel which prevents the handles from collapsing during use.

Further objects, features and advantages of the invention will be apparent from the following detailed description when taken in conjunction with the accompanying drawings.

DESCRIPTION OF THE PREFERRED EMBODIMENTS

Figure 1:
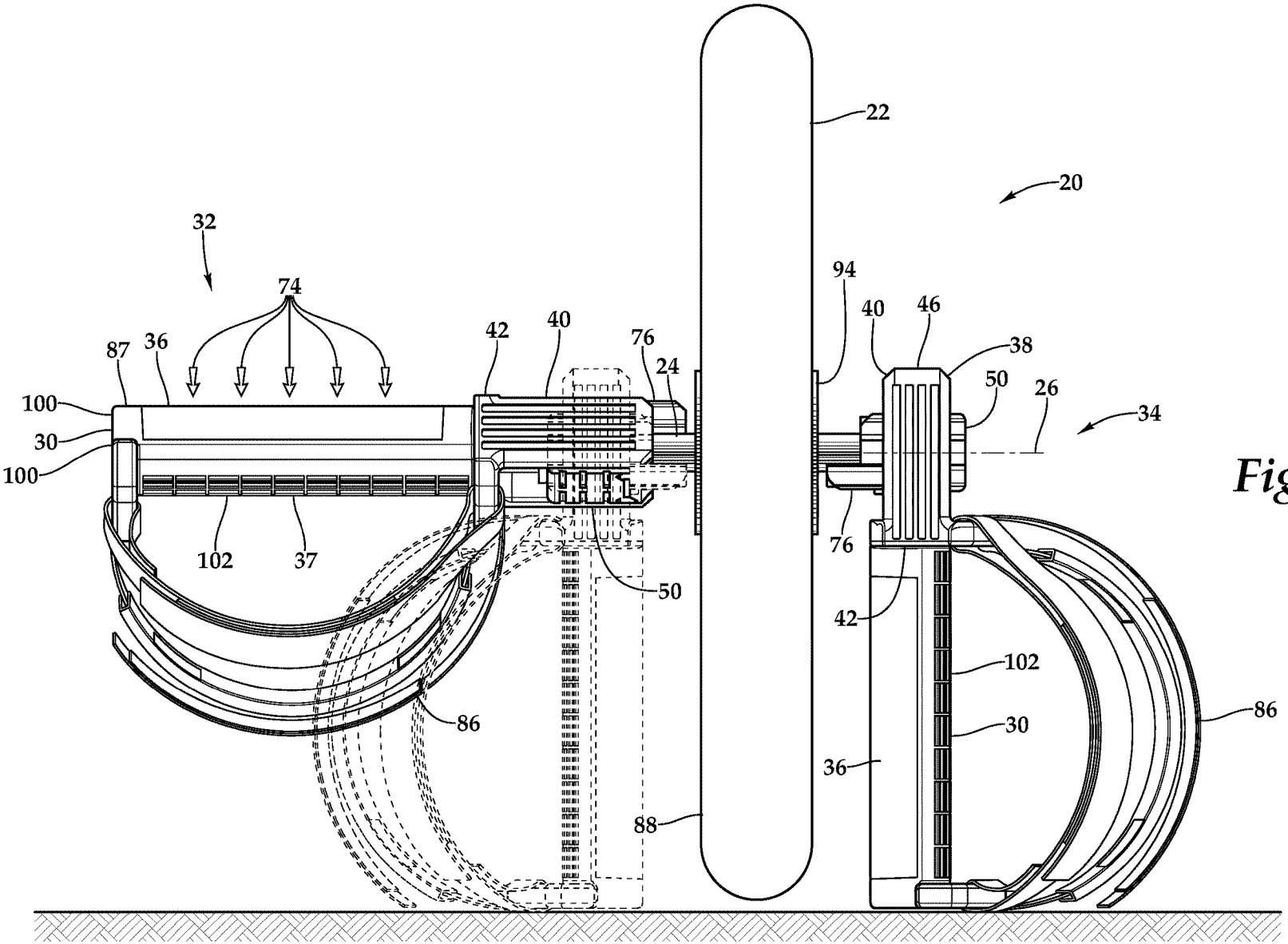
FIG. 1 is a front elevational view of the core wheel of this invention, with one handle extended for use, and one collapsed as in the storage configuration, with certain straps omitted.
Figure 2:
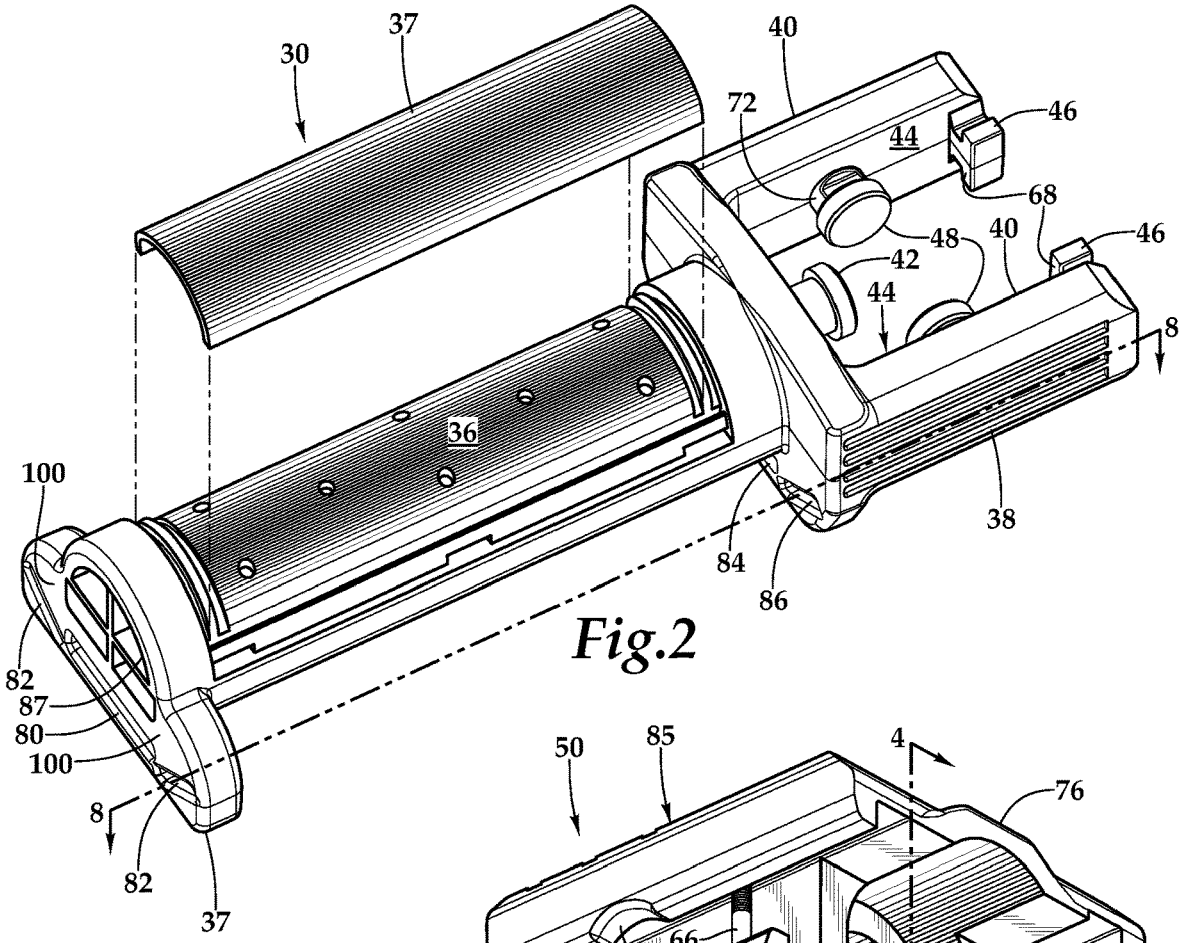
FIG. 2 is a top isometric view of one of the handles forming a part of the core wheel of FIG. 1.

Referring more particularly to FIGS. 1-9, wherein like numbers refer to similar parts, an exercise device known as a core wheel 20 is shown in FIG. 1. The core wheel 20 comprises a wheel 22 with an axial shaft 24 passing through an axis of rotation 26 about which the wheel rotates. Mounted on each end of the axial shaft 24 is a block 50 which is mounted about the shaft. Handles 30 are movable between a first exercise or use position 32, as shown on the left in FIG. 1, and a collapsed storage position 34 shown on the right of FIG. 1. As shown in FIG. 2, each handle 30 has a palm, i.e., metacarpus, rest, on a grip 37 which bears the weight of a person exercising with the core wheel 20. Extending axially away from the palm rest 36 is a fork 38 which has two parallel arms 40 mounted to a base 42 from which the grip 37 extends. Each arm 40 has an inwardly facing surface 44 to which is mounted a T-shaped protrusion 46 and a table-shaped protrusion 48.

Figure 4:
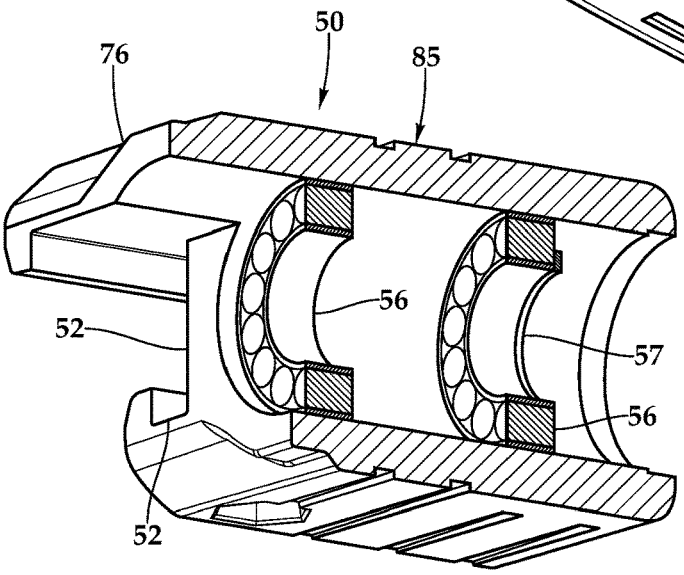
FIG. 4 is an isometric cross-sectional view of the axial block of FIG. 3 taken along section line 4-4.
Figure 5:
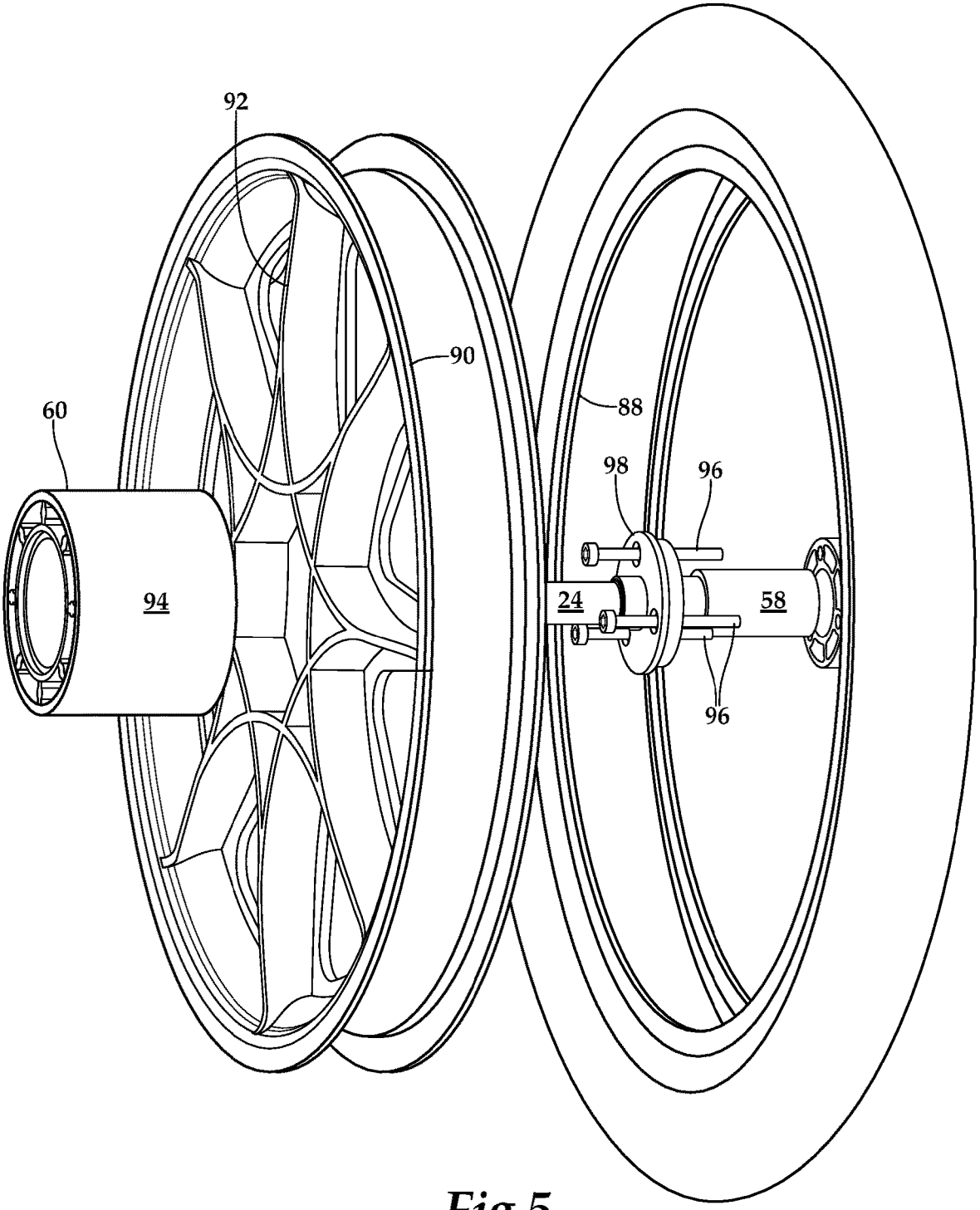
FIG. 5 is an exploded isometric view of the wheel and shaft of the core wheel of FIG. 1.
Figure 7:
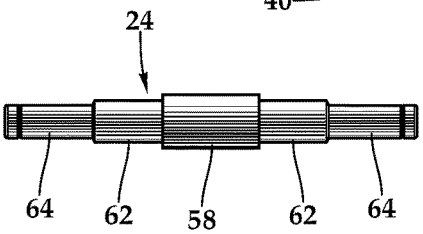
FIG. 7 is a front elevational view of the axle shaft of the core wheel of FIG. 1.

A mechanism is provided between the shaft and each handle to collapse the handle to a collapsed position perpendicular to the rotational axis. The mechanism has a shaft-mounted block 50, best shown in FIG. 3, which has two spaced apart T-shaped slots 52, and a central shaft receiving opening 54. As shown in FIG. 4, roller bearings 56 are positioned on either end of the shaft opening 54 and held in place by circlips 57. The shaft 24, as shown in FIG. 7, has a central portion 58 of increased diameter which fits within an axial spacer 60 as shown in FIG. 5. On either side of the central portion 58 the shaft 24 has axial portions 62 of smaller diameter which extend to the blocks 50, and further beyond the axle portions 62 are yet smaller diameter portions 64 which form bearing pinions which ride on the bearings 56.

Figure 3:
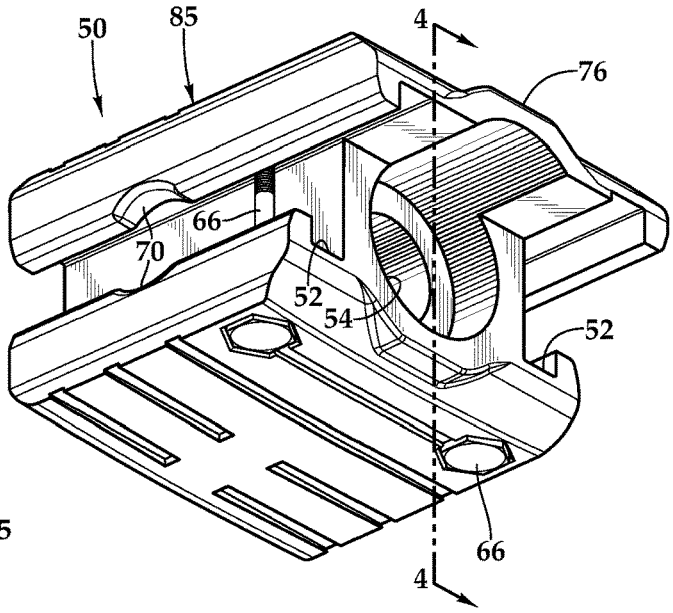
FIG. 3 is a bottom isometric view of an axial block which mounts to an axial shaft of the core wheel of FIG. 1.
Figure 6:
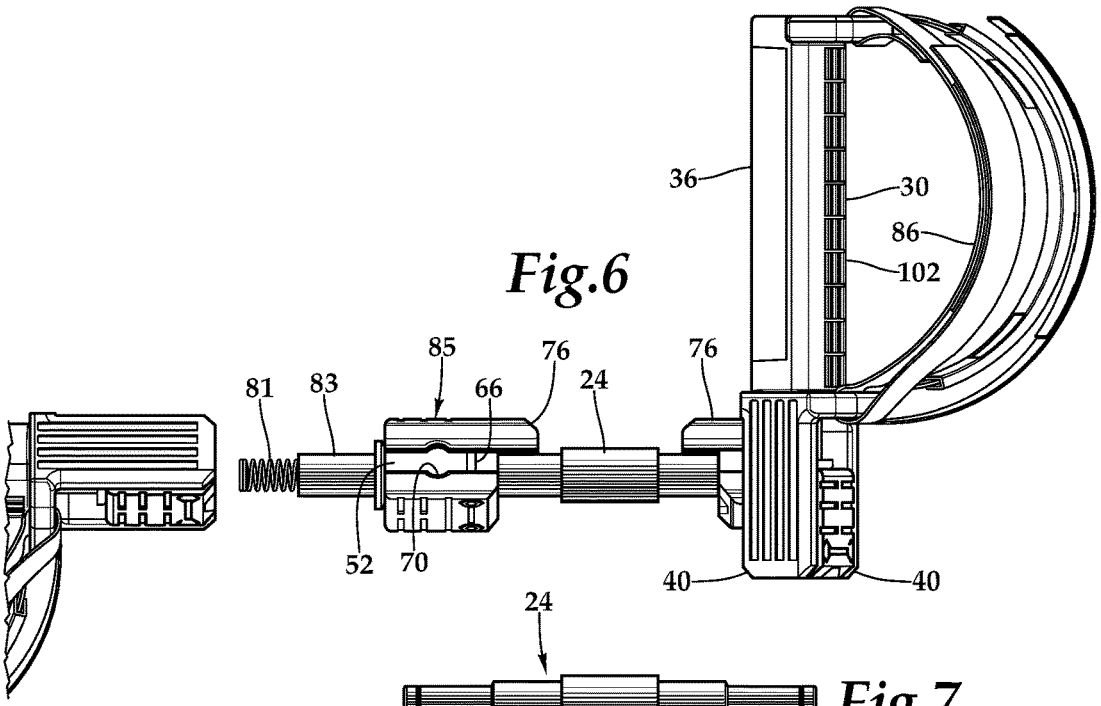
FIG. 6 is a fragmentary isometric view partly exploded of the core wheel of FIG. 3.

As shown in FIG. 3, the two T-shaped slots 52 in each block are interrupted by pins or bolts 66 which extend through the slots and limit the travel of the T-shaped protrusions 46 within the T-shaped slots of the block 50 as they extend toward the handles. The pins 66 prevent the T-shaped slots 52 from sliding beyond the point where the pins 66 engage the inner surfaces 68 of the T-shaped protrusions 46. Each block 50 has portions which define cylindrical enlargements 70 of each T-shaped slot 52. The enlargements 70 engage circular surfaces 72 of the table-shaped protrusions 48 when the grip 37 is pushed toward the wheel 22 such that the T-shaped protrusions extend beyond the block and the table-shaped protrusions are located in the cylindrical enlargements 70 so that the handle 30 can rotate. As best shown in FIG. 6, a spring 81 and piston 83 are mounted to the base 42 shown in FIG. 2 to push the handle 30 away from the block until the surfaces 68 of the T-shaped protrusions 46 abut the pins 66. When being used for exercise, the handles 30, as shown in the left of FIG. 1, both extend axially along the axis of rotation 26. Each handle 30 is held in place by its handle spring 81 and piston 83 and against rotation into the storage configuration by the two protrusions 46, 48 which are constrained within the T-shaped slots 52 of the block. To collapse the handles 30 for storage they are pushed in toward the wheel 22 until the T-shaped protrusions 46 slide out of the T-shaped slots 52 thus allowing rotation of the handle about the table-shaped protrusions 48.

When exercising with the core wheel 20 the weight of the body, as indicated by arrows 74 in FIG. 1, is supported on the palm rests 36 shown in FIGS. 1 and 2. Each block 50 has an extension or protruding portion 76 which extends axially toward the wheel 22. The protruding portions are disposed such that, when the handles 30 are pushed toward the wheel 22, the T-shaped protrusions which have been slid out of the slots 52 are only allowed to rotate in one direction to position the palm rest 36 parallel to the wheel. Thus, even if a handle 30 is driven toward the wheel the handle is prevented from collapsing with respect to the block under load. In other words, the protruding portions 76 block the collapse of the handles when weight is applied to the palm rests, so that the user must pivot the handles upwardly in order to bring the handle into the stored configuration.

To collapse the handles 30, the handles are pushed toward the wheel 22 so that the T-shaped protrusions 46 slide out of the T-shaped slots 52 and allow the handles to rotate about the blocks 50 on the table-shaped protrusions 48. When each handle 30 has rotated 90°, each spring 81 loaded piston 83 bears against an outwardly facing side 85 of the block 50, thereby supporting the handle 30 in a 90°-rotated position as shown on the right in FIGS. 1 and 6.

Each handle 87 base has an outermost flat support surface 100. The handles 30 have a length in the collapsed position such that the flat support surfaces 100 are the lowermost portions of the handles 87 which extend to a radial distance equal to or greater than the radius of the wheel 22. The handles thus provide a two- or three-point support for the core wheel 20.

Figure 8:
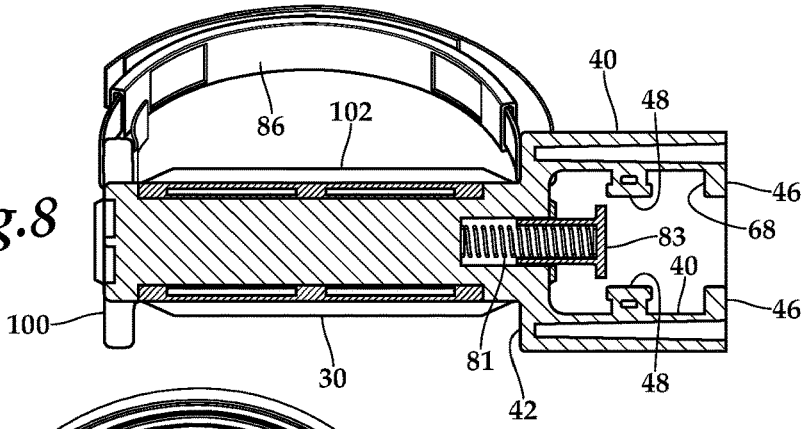
FIG. 8 is a cross-sectional view of the handle of FIG. 2, with strapping shown, taken along section line 8-8.
Figure 9:
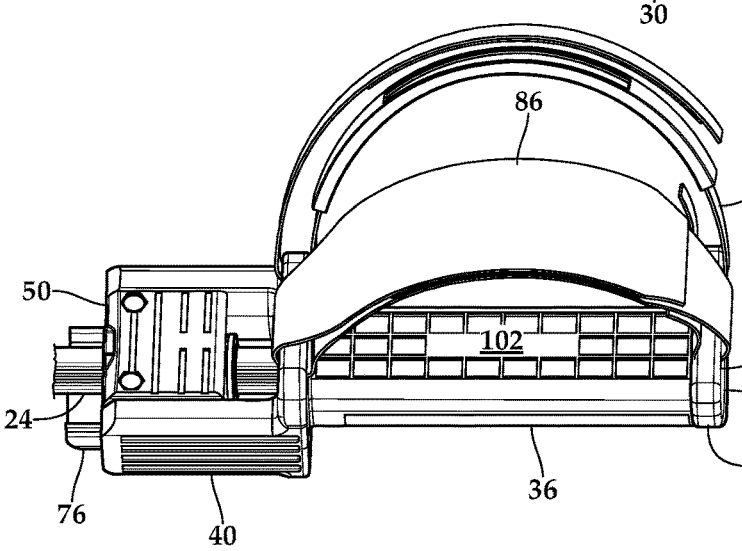
FIG. 9 is a bottom axonometric view of the handle of FIG. 8.

As shown in FIGS. 2 and 9, each handle 30 has an end 87 opposite the base 42. The end 87 has three openings: a large slot 80 opposite the palm rest 36 and extending in the plane defined by the parallel arms 40 for a foot cuff 86, and the two smaller slots 82 on either side of the larger slot for a heel cuff 204. The base 42 has corresponding openings 84, 86. Webbing 86, as shown in FIGS. 6, 8, and 9 may be threaded between opposed openings and used for such purposes as supporting a foot tucked under the handle 30.

Each handle 30 has a non-slip foot engaging surface 102 on the opposite side of the handles 30 from the palm rest 36 as shown in FIG. 9. Thus, one side of the handles 30 is for the hands and the other side 102 is a support for the feet.

The foot can be controlled in place by the foot cuff 86, which wraps around the top of the foot. This secures the foot on the engaging surface 102 when the person exercising is in either the prone or supine position. The heel cuff 204 secures the back of the foot so it doesn't slip off the foot engaging surface 102 when the user is in the supine position. The foot cuff 86 and the heel cuff 204 have hook and loop fasteners so the foot cuff and heel cuff can be adjusted to achieve a desired fit.

The assembly of the wheel 22 shaft 24 is shown in FIG. 5. A tire 88, which may be solid or may be filled with foam or air, is mounted to a rim 90. The rim may be co-formed with plastic webbing 92 which forms spokes. Within the webbing 92 is a hub 94 which is mounted to the central portion 58 of the axial shaft 24 by three bolts 96 which hold end clamps 98 which lock the hub to the shaft.

It should be understood that although a single shaft is shown and described with two roller bearings mounted to the block 40, a split shaft made of two smaller shafts could be mounted on the axial spacer 60 so as to rotate, with or without additional bearings in the axial spacer.

It is understood that the invention is not limited to the particular construction and arrangement of parts herein illustrated and described, but embraces all such modified forms thereof as come within the scope of the following claims.

We claim:

1. An exercise device comprising:

a wheel having a radius, a rotational axis, and a radial outermost surface for engaging a surface as the wheel rolls over said surface;

at least one shaft extending along the rotational axis;

two handles rotatably mounted to the wheel by the at least one shaft to extend along the rotational axis in a first position;

wherein each handle has a palm rest for an operator support when exercising;

a mechanism between the at least one shaft and each handle to collapse the handle to a collapsed position perpendicular to the rotational axis; and wherein the two handles when in the collapsed position extend at least to the radial outermost surface.

2. The exercise device of claim 1 wherein the mechanism between the at least one shaft and each handle to collapse the handle to the collapsed position only allows collapse of the handles in a single direction to thereby prevent the handles from rotating in a direction they are loaded in use, thus preventing the handles from collapsing under load.

3. The exercise device of claim 1 wherein the mechanism between the at least one shaft and each handle to collapse the handle to the collapsed position further comprises:

a block mounted to each end of the at least one shaft that extends outwardly of the wheel along the rotational axis;

wherein each handle has a fork which has two parallel arms mounted to a base, wherein each arm has an inwardly facing surface to which is mounted a first protrusion and a second shaped protrusion spaced along the arm from the first protrusion;

wherein each block has two spaced apart slots shaped to slide on the first and second protrusion;

wherein each of the two slots is interrupted by pins which limit the movement of the first protrusions;

wherein each handle has a spring powered piston mounted to the base and pushing on the block so that the handle is positioned with the first protrusions engaging the pins; and wherein the second protrusions are rotatable within the slots when the first protrusions are removed from the slots by compressing the pistons by moving the handles along the rotational axis toward the wheel.

4. The exercise device of claim 1 wherein each handle has an outermost flat support surface, and the handles have a length in the collapsed position such that the flat support surfaces are the lowermost portions of the handles which extend to a radial distance equal to or greater than the radius of the wheel, the handles thus providing support for the exercise device.

5. An exercise device comprising:

a wheel having a radius, a rotational axis, and a radial outermost surface for engaging a surface as the wheel rolls over said surface;

a hub fixed to the wheel at a location radially inward of the radial outermost surface;

shaft portions extending from the hub along the rotational axis, on opposite sides of the wheel;

a first handle extending on one side of the wheel, and a second handle extending on an opposite side of the wheel, the two handles rotatably mounted to the wheel by the hub to extend along the rotational axis in a first position;

wherein each handle has a palm rest for an operator's support when exercising;

wherein each handle is connected to the shaft portions such that the handles are collapsible from the first position to a second collapsed position, in which the handles remain connected to the shaft portions and in the second position extend perpendicular to the rotational axis, the two handles extending in the collapsed position beyond the wheel radial outermost surface to provide a support for the exercise device on a support surface.

6. The exercise device of claim 5 wherein each handle has an outermost flat support surface which engages the support surface in the collapsed position.

7. An exercise device comprising:

a wheel having a radius, a rotational axis, and a radial outermost surface for engaging a surface as the wheel rolls over said surface;

at least one shaft extending along the rotational axis;

two handles rotatably mounted to the wheel by the at least one shaft to extend along the rotational axis in a first position;

wherein each handle has a palm rest for an operator's support when exercising;

wherein each handle is connected to the at least one shaft such that the handles are collapsible from the first position to a second collapsed position, in which the handles extend perpendicular to the rotational axis, the two handles extending in the collapsed position beyond the wheel radial outermost surface to provide a support for the exercise device on a support surface, wherein each handle is connected to the at least one shaft such that the handle is configured to only be collapsed in a single direction to thereby prevent the handles from rotating in a direction that is loaded in use, thus preventing the handles from collapsing under load.

8. An exercise device comprising:

a wheel having a radius, a rotational axis, and a radial outermost surface for engaging a surface as the wheel rolls over said surface;

at least one shaft extending along the rotational axis;

two handles rotatably mounted to the wheel by the at least one shaft to extend along the rotational axis in a first position;

wherein each handle has a palm rest for an operator's support when exercising;

wherein each handle is connected to the at least one shaft such that the handles are collapsible from the first position to a second collapsed position, in which the handles extend perpendicular to the rotational axis, the two handles extending in the collapsed position beyond the wheel radial outermost surface to provide a support for the exercise device on a support surface;

a block mounted to each end of the at least one shaft that extends outwardly of the wheel along the rotational axis;

portions of each handle defining a fork which has two parallel arms mounted to a base, wherein each arm has an inwardly facing surface to which is mounted a first protrusion and a second shaped protrusion spaced along the arm from the first protrusion;

wherein each block has two spaced apart slots shaped to slide on the first and second protrusion;

wherein each of the two slots is interrupted by pins which limit the movement of the first protrusions;

wherein each handle has a spring powered piston mounted to the base and pushing on the block so that the handle is positioned with the first protrusions engaging the pins; and wherein the second protrusions are rotatable within the slots when the first protrusions are removed from the slots by compressing the pistons by moving the handles along the rotational axis toward the wheel.

9. An exercise device comprising:

a wheel having a radius, a rotational axis, and a radial outermost surface for engaging a surface as the wheel rolls over said surface;

at least one shaft extending along the rotational axis;

two handles rotatably mounted to the wheel by the at least one shaft to extend along the rotational axis in a first position;

wherein each handle has a palm rest for an operator's support when exercising;

a block mounted to each end of the at least one shaft that extends outwardly of the wheel along the rotational axis;

wherein each handle has a fork which has two arms mounted to a base, wherein each arm has an inwardly facing surface to which is mounted a first protrusion and a second protrusion spaced along the arm from the first protrusion;

wherein each block has two spaced apart slots shaped to slide on the first and second protrusions, such that the handles are collapsible to a collapsed position perpendicular to the rotational axis; and wherein the two handles when in the collapsed position extend at least to the radial outermost surface.

10. The exercise device of claim 9 wherein each block and its attached handle has a projection which allows the handle to collapse only in a single direction to thereby prevent the handles from rotating in a direction they are loaded in use, thus preventing the handles from collapsing under load.

11. The exercise device of claim 9 wherein each of the two slots is interrupted by pins which limit the movement of the first protrusions;

wherein each handle has a spring powered piston mounted to the base and pushing on the block so that the handle is positioned with the first protrusions engaging the pins; and wherein the second protrusions are rotatable within the slots when the first protrusions are removed from the slots by compressing the pistons by moving the handles along the rotational axis toward the wheel.

12. The exercise device of claim 9 wherein each handle has an outermost flat support surface, and the handles have a length in the collapsed position such that the flat support surfaces are the lowermost portions of the handles which extend to a radial distance equal to or greater than the radius of the wheel, the handles thus providing support for the exercise device.

* * * * *